US009841734B2

(12) United States Patent
Merino et al.

(10) Patent No.: US 9,841,734 B2
(45) Date of Patent: Dec. 12, 2017

(54) TIMEPIECE DISPLAY MECHANISM WITH A FAST CORRECTOR

(71) Applicant: ETA SA Manufacture Horlogere Suisse, Grenchen (CH)

(72) Inventors: Antonio Merino, Moutier (CH); Jean-Luc Helfer, Le Landeron (CH); Christian Ruefenacht, Bienne (CH); Giuseppe Cappadona, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 15/125,231

(22) PCT Filed: Apr. 9, 2015

(86) PCT No.: PCT/EP2015/057673

§ 371 (c)(1),
(2) Date: Sep. 12, 2016

(87) PCT Pub. No.: WO2015/172943

PCT Pub. Date: Nov. 19, 2015

(65) Prior Publication Data

US 2017/0075307 A1 Mar. 16, 2017

(30) Foreign Application Priority Data

May 14, 2014 (EP) ..... 14168333

(51) Int. Cl.
*G04B 27/06* (2006.01)
*G04B 19/25* (2006.01)
(Continued)

(52) U.S. Cl.
CPC ..... *G04B 19/25* (2013.01); *G04B 18/02* (2013.01); *G04B 27/06* (2013.01); *G04C 11/06* (2013.01)

(58) Field of Classification Search
CPC ..... G04B 19/25; G04B 18/02; G04B 27/06; G04B 19/00; G04B 19/24; G04C 11/06
See application file for complete search history.

(56) References Cited

U.S. PATENT DOCUMENTS 3,427,798 A 2/1969 Rogers et al.
3,890,778 A * 6/1975 Aeschmann ..... G04B 19/25 368/319

(Continued)

FOREIGN PATENT DOCUMENTS

EP 1 462 878 A2 9/2004
GB 1 205 962 A 9/1970
WO 2012/175595 A1 12/2012

OTHER PUBLICATIONS

International Search Report dated Nov. 13, 2015 in PCT/EP2015/057673 Filed Apr. 9, 2015.

*Primary Examiner* — Sean Kayes
(74) *Attorney, Agent, or Firm* — Oblon, McClelland, Maier & Neustadt, L.L.P.

(57) ABSTRACT

A display mechanism including a mechanism for fast correction of a position of a display wheel set, an intermediate wheel set ensuring synchronization with an automatic drive mechanism, and, inserted between the intermediate wheel set and the display wheel set, a safety lever driven by the display wheel set during periodic driving thereof, in a trajectory that interferes with a spatial volume of the intermediate wheel set, such that, when the intermediate wheel set is correctly synchronized, the trajectory of the lever does not interfere with the intermediate wheel set, and, when the intermediate wheel set is not correctly synchronized, the trajectory of the safety lever interferes with the intermediate wheel set, which the safety lever then drives in an opposite direction to a single direction of normal operation, to resynchronize the intermediate wheel set.

9 Claims, 8 Drawing Sheets

(51) Int. Cl.
*G04B 18/02* (2006.01)
*G04C 11/06* (2006.01)

(56) References Cited

U.S. PATENT DOCUMENTS

| | | | | |
|---|---|---|---|---|
| 4,027,468 | A | 6/1977 | Felty et al. | |
| 7,980,756 | B2 * | 7/2011 | Graemiger | G04B 27/065 368/184 |
| 9,170,563 | B2 * | 10/2015 | Rudaz | G04B 27/04 |
| 2004/0208085 | A1 | 10/2004 | Watanabe et al. | |
| 2014/0177397 | A1 | 6/2014 | Rudaz et al. | |

* cited by examiner

TIMEPIECE DISPLAY MECHANISM WITH A FAST CORRECTOR

CROSS-REFERENCE TO RELATED APPLICATIONS

This is a National phase application in the United States of International patent application PCT/EP2015/057673 filed Apr. 09, 2015 which claims priority on European patent application 14168333.4 of May 14, 2014. The entire disclosures of the above patent applications are hereby incorporated herein by reference.

FIELD OF THE INVENTION

The invention concerns a display mechanism for timepieces, comprising a fast position correction mechanism for a display wheel set.

The invention also concerns a timepiece movement including at least one display mechanism of this type.

The invention also concerns a timepiece or watch comprising at least one such movement and/or at least one such display mechanism.

The invention concerns the field of timepiece display mechanisms, and more specifically, comprising fast correction mechanisms.

BACKGROUND OF THE INVENTION

This invention concerns watches which require a fast (day, month or other) correction mechanism for certain functions, in particular display functions such as a calendar (annual, perpetual, day/date, or other), or moon phase, tide, AM/PM display or other indicators. A particular example of an annual calendar mechanism is described in Patent No EP1666991B1 in the name of ETA SA.

To set the month, the user generally has to make a correction using the calendar mechanism. In the worst case, this operation may prove time-consuming and tedious. It may be that a correction of a whole year has to be made. Likewise, if the user makes a mistake during correction, the operation has to be repeated. Using the calendar mechanism to operate the correction mechanism may lead to excessive use and could result in malfunctions.

Correction mechanisms often include levers, which are essential components in timepiece movements, enabling a mechanism to switch between several different modes, in general between two distinct positions. A return spring is often provided with a timepiece lever to ensure proper motion transmission or continued bins depending on the case.

A fast correction of the month display may result in desynchronization of the system. The user then has no means of checking whether the system is synchronized, which may lead to malfunctions.

SUMMARY OF THE INVENTION

The invention proposes to prevent such desynchronization of a calendar or date mechanism, and enables the calendar mechanism to self-synchronize.

The present invention proposes to overcome the aforementioned drawbacks of the prior art and to prevent any desynchronization of the mechanism.

To this end, the invention concerns a timepiece display mechanism according to claim 1.

The invention also concerns a timepiece movement comprising at least one such display mechanism.

The invention also concerns a timepiece or watch comprising at least one such movement and/or at least one such display mechanism.

BRIEF DESCRIPTION OF THE DRAWINGS

Other features and advantages of the invention will appear upon reading the following detailed description, with reference to the annexed drawings, in which:

FIG. 4 shows a set of schematic cross-sections passing through the pivot axes of the main wheel sets.

DETAILED DESCRIPTION OF PREFERRED EMBODIMENTS

Figure 1:
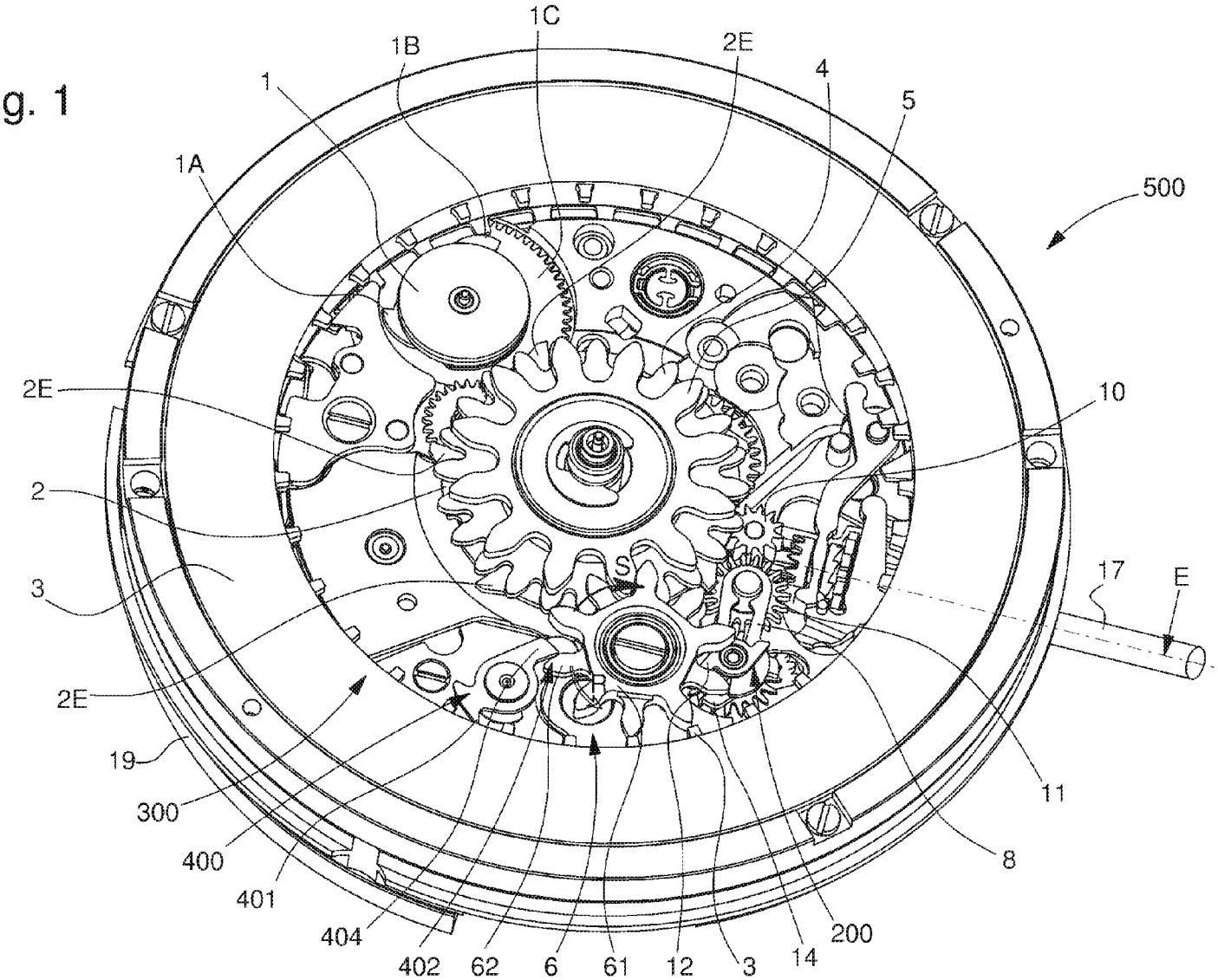
FIG. 1 shows a partial perspective schematic view of a watch comprising a display mechanism according to the invention, in the particular application to an annual calendar mechanism.
Figure 2:
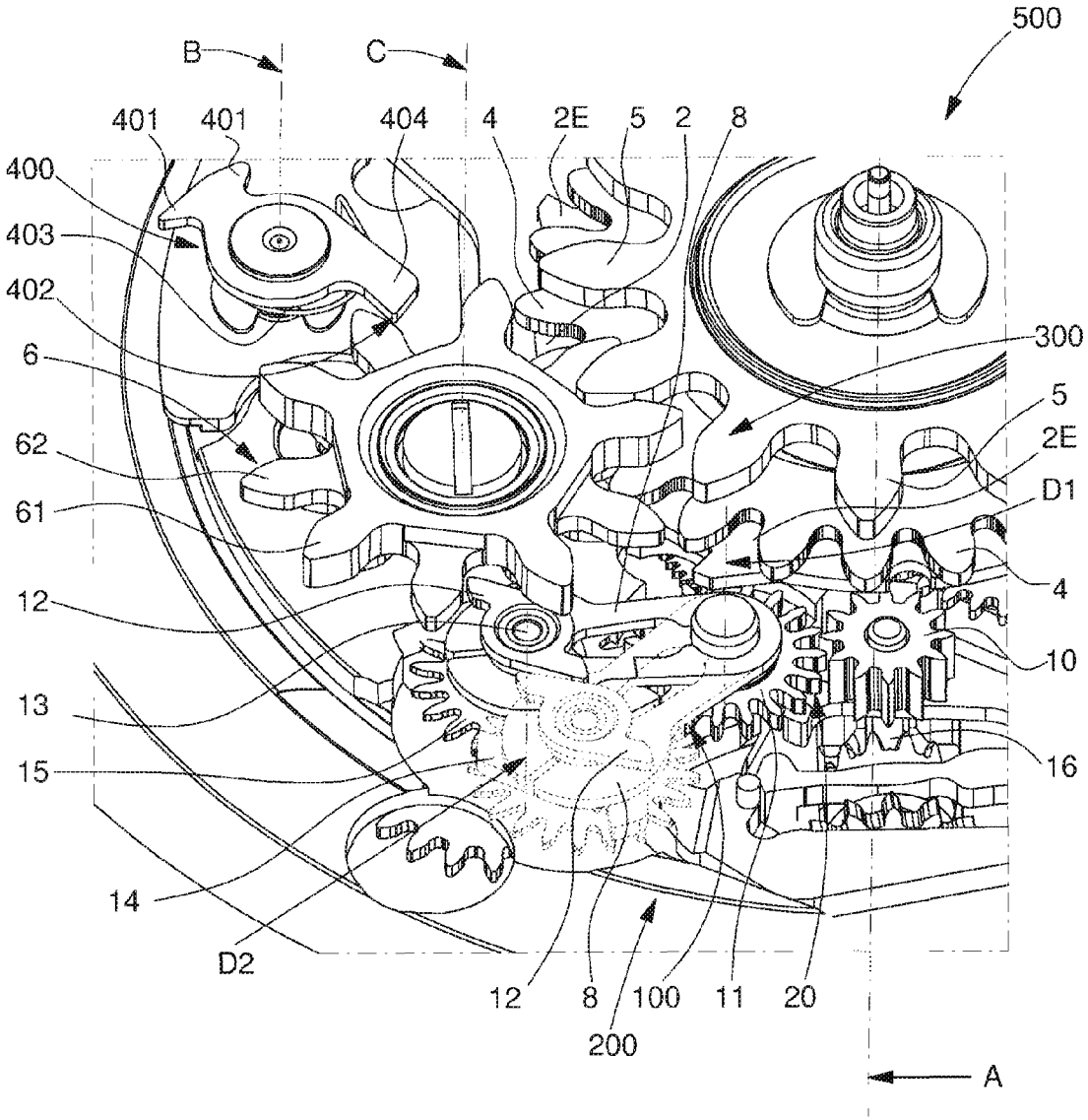
FIG. 2 represents a detail of FIG. 1 with fast calendar correction means illustrated in two different positions.
Figure 3:
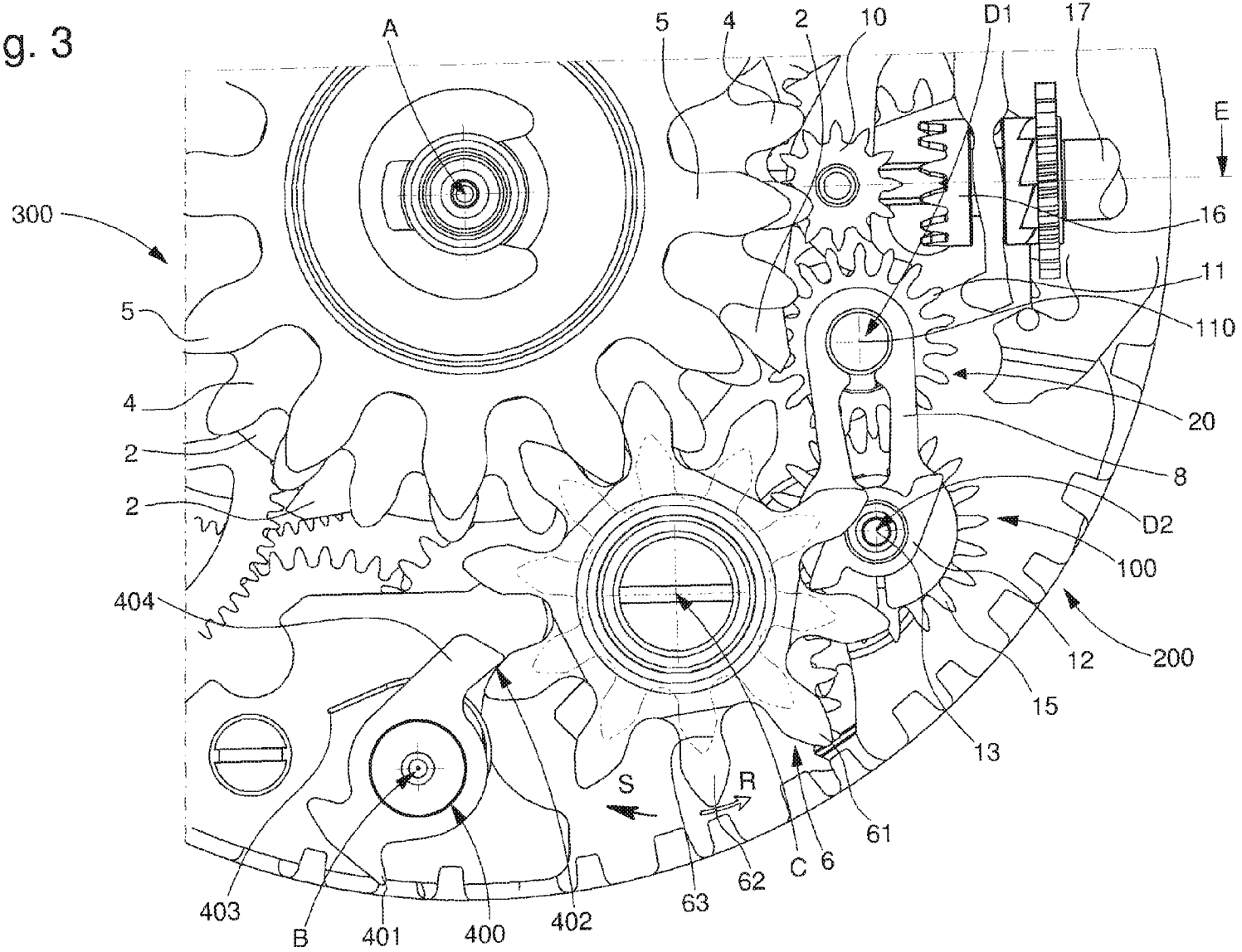
FIG. 3 shows a schematic plan view of a watch movement comprising a calendar mechanism with a fast automatic correction mechanism according to FIG. 1.
Figure 4A:
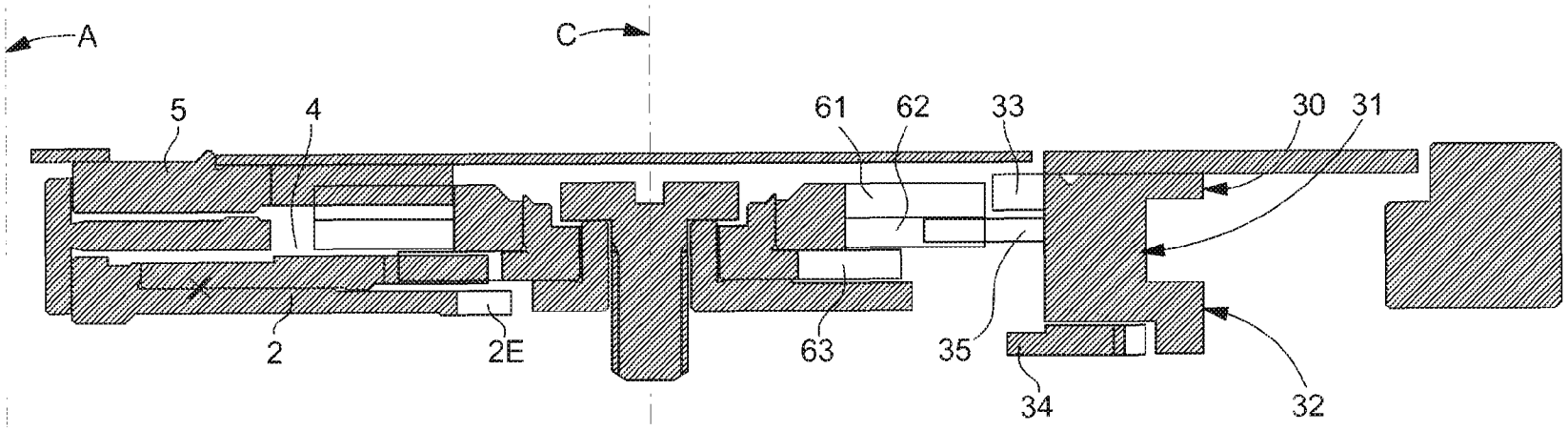
FIG. 4A represents the cooperation between an intermediate wheel set and a particular date ring comprised in said calendar mechanism.

The invention concerns the field of timepiece mechanisms, and more specifically control and motion transmission mechanisms. It finds preferred application in the correction and updating of display mechanisms, and more specifically in display mechanisms 500 comprising a fast correction mechanism 200, controlled by the user, via control means 17, such as a stem or similar.

A display mechanism 500 is conventionally driven by an automatic drive mechanism controlled by a movement 1000 comprised in timepiece 2000, notably a watch, in which is integrated display mechanism 500. In normal operation, the kinematic chain of the display mechanism, via a drive means 1, ensures the periodic driving of at least one display wheel set 3. Preferably, the periodic driving is accomplished directly by a wheel set 1C downstream of a gear train driven by movement 1000, preferably arranged to complete one revolution in twenty-four hours.

Timepiece display mechanisms generally comprise at least one freely mounted wheel set, which is held in position by a friction spring, or by elastic return means, such as a jumper spring or suchlike.

A fast correction mechanism 200 generally includes means arranged to uncouple the automatic drive mechanism, and to replace at least one wheel set of the kinematic chain of said automatic drive mechanism with at least one other wheel set arranged to drive, directly or indirectly, at least one display wheel set 3, and thereby effect a change of position of said display wheel set.

The invention proposes to improve such a mechanism to make desynchronization of the assembly impossible.

According to the invention, fast correction mechanism 200 comprises, in immediate proximity to display wheel set 3, at least one intermediate wheel set 6, which pivots in normal mode in a single direction S. According to variants, intermediate wheel set 6 may, on different parallel stages, fulfil different functions.

At the very least, the intermediate wheel net ensures, on a first stage 61, synchronization with display mechanism 500: the angular orientation of intermediate wheel set 6 with respect to the automatic drive mechanism of the display mechanism is then correct.

According to the invention, inserted between intermediate wheel set 6 and display wheel set 3, display mechanism 500 comprises a safety lever 400, also called the synchronization lever.

This safety lever 400 is arranged to be driven by display wheel set 3, when display wheel set 3 is periodically driven, in a determined trajectory and with a travel that interferes with the spatial volume of intermediate wheel set 6. The relative arrangement of safety lever 400 and intermediate wheel set 6, which are mounted to pivot about distinct parallel axes, is such that:

- when intermediate wheel set 6 is correctly synchronized, the trajectory of safety lever 400 does not interfere with a first intermediate wheel set located on a first stage 61 of intermediate wheel set 6, and safety lever 400 is arranged to pass at a distance from any other surface of intermediate wheel set 6, without interfering with intermediate wheel set 6;
- when the intermediate wheel set 6 is not correctly synchronized, the trajectory of safety lever 400 interferes with the first intermediate wheel set on first stage 61 of intermediate wheel set 6, and safety lever 400 is arranged to drive intermediate wheel set 6 in the opposite direction R to the single normal operation direction S, to resynchronize intermediate wheel set 6.

In the particular and non-limiting variant illustrated by the Figures, intermediate wheel set 6 is arranged to ensure:

- on a first stage 61, synchronization with the automatic drive means of display mechanism 500;
- on a second stage 62, the direct or indirect driving of a display wheel set other than first display wheel set 3.

The relative arrangement of intermediate wheel set 6 and safety lever 400 is then such that:

- when intermediate wheel set 6 is correctly synchronized the trajectory of safety lever 400 does not interfere with the first intermediate wheel set on first stage 61 of intermediate wheel set 6, and safety lever 400 is arranged to pass above and at a distance from a second intermediate wheel set located on second stage 62 of intermediate wheel set 6, without interfering therewith;
- when the intermediate wheel set 6 is not correctly synchronized, the trajectory of safety lever 400 interferes with the first intermediate wheel set on first stage 61 of intermediate wheel set 6, and safety lever 400 is arranged to drive intermediate wheel set 6 in the opposite direction R to the single normal operation direction S, to resynchronize intermediate wheel set 6.

The first intermediate wheel set on first stage 61 and the second intermediate wheel set on second stage 62 are integral in rotation. In a particular embodiment, intermediate wheel set 6 is in one-piece.

In both cases, the travel of safety lever 400 is complete when display wheel set 3 ceases driving said lever. Safety lever 400 is advantageously equipped with elastic return means 403, which tend to permanently return it to a rest position, which is the start of cooperation position, in the next period, with display wheel set 3.

Preferably, intermediate wheel set 6 comprises a first intermediate wheel on first stage 61 and a second intermediate wheel set on second stage 62.

The first intermediate wheel comprises teeth alternating with other teeth comprised in the second intermediate wheel. Advantageously, in projection on a plane, the teeth of the first intermediate wheel and those of the second intermediate wheel have the same profile, and some of them are aligned. More specifically, the first intermediate wheel comprises half as many teeth as the second intermediate wheel; the teeth are identical and one out of two is aligned. Consequently, the aligned teeth extend in double thickness on first stage 61 and on second stage 62, whereas the teeth of the second intermediate wheel which have no corresponding tooth on the first intermediate wheel only extend on second stage 62. In the particular variant illustrated, the second intermediate wheel includes ten teeth, and the first intermediate wheel has five.

Preferably, safety lever 400 comprises a blade portion 404 which only extends on the first stage. This blade 404 comprises a stop surface 402 arranged to repel the toothing of the first intermediate wheel set at first stage 61 in the event of desynchronization. On the opposite side with respect to a pivot axis B, lever 400 preferably has a beak 401, arranged to cooperate with display wheel set 3, to drive safety lever 400 via said display wheel set.

In a more specific embodiment, intermediate wheel set 6 also includes, on a third stage which does not interfere with safety lever 400, a third toothed wheel 63. This third toothed wheel 63 is then arranged to mesh, directly or indirectly, with another display wheel set.

The invention is more particularly illustrated, in a non-limiting manner, for the advantageous application wherein display mechanism 500 is a calendar mechanism 300, comprising a data drive wheel set 1, arranged to be controlled by a wheel of a timepiece movement 1000 and arranged to control a year wheel 4. At least one said display wheel set 3 is a date ring, and calendar mechanism 300 comprises control means arranged to drive, directly or indirectly, said at least one date ring 3. Calendar mechanism 300 further comprises a fast date correction mechanism 200, which is arranged to control, directly or indirectly, the pivoting of said date ring 3.

Figure 7:
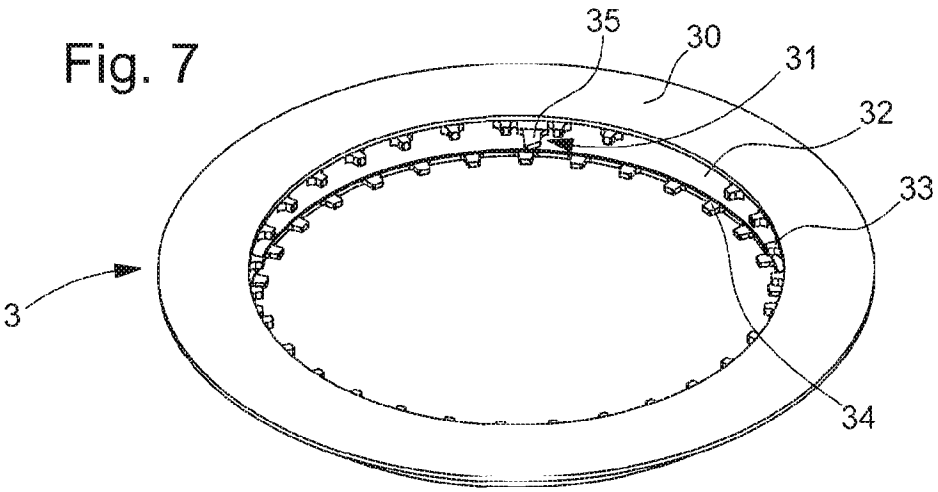
FIG. 7 shows a schematic, perspective view of a particular date ring specific to the invention.
Figure 4B:
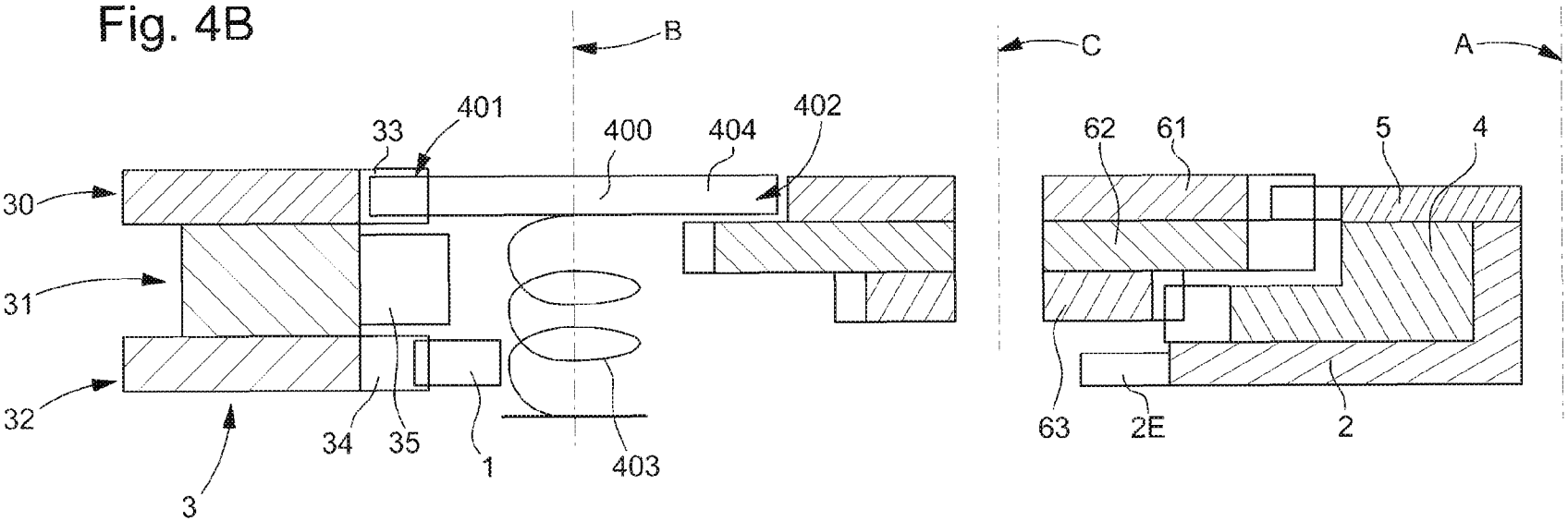
FIG. 4B shows the cooperation of a safety lever according to the invention with the date ring and with the intermediate wheel, in a position in which the intermediate wheel is properly synchronized.
Figure 4C:
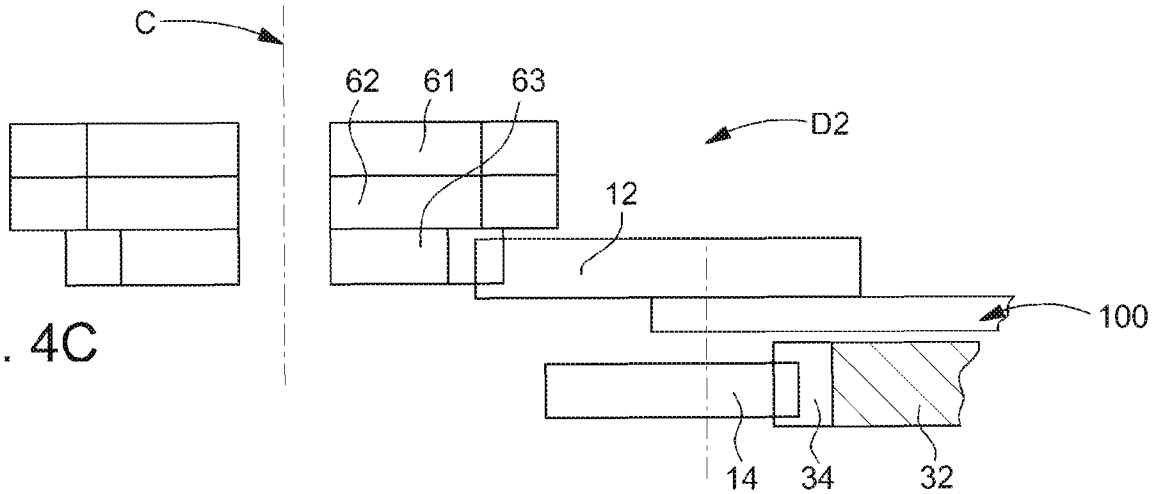
FIG. 4C shows the cooperation of a fast correction mechanism with the data ring and with the intermediate wheel.
Figure 5:
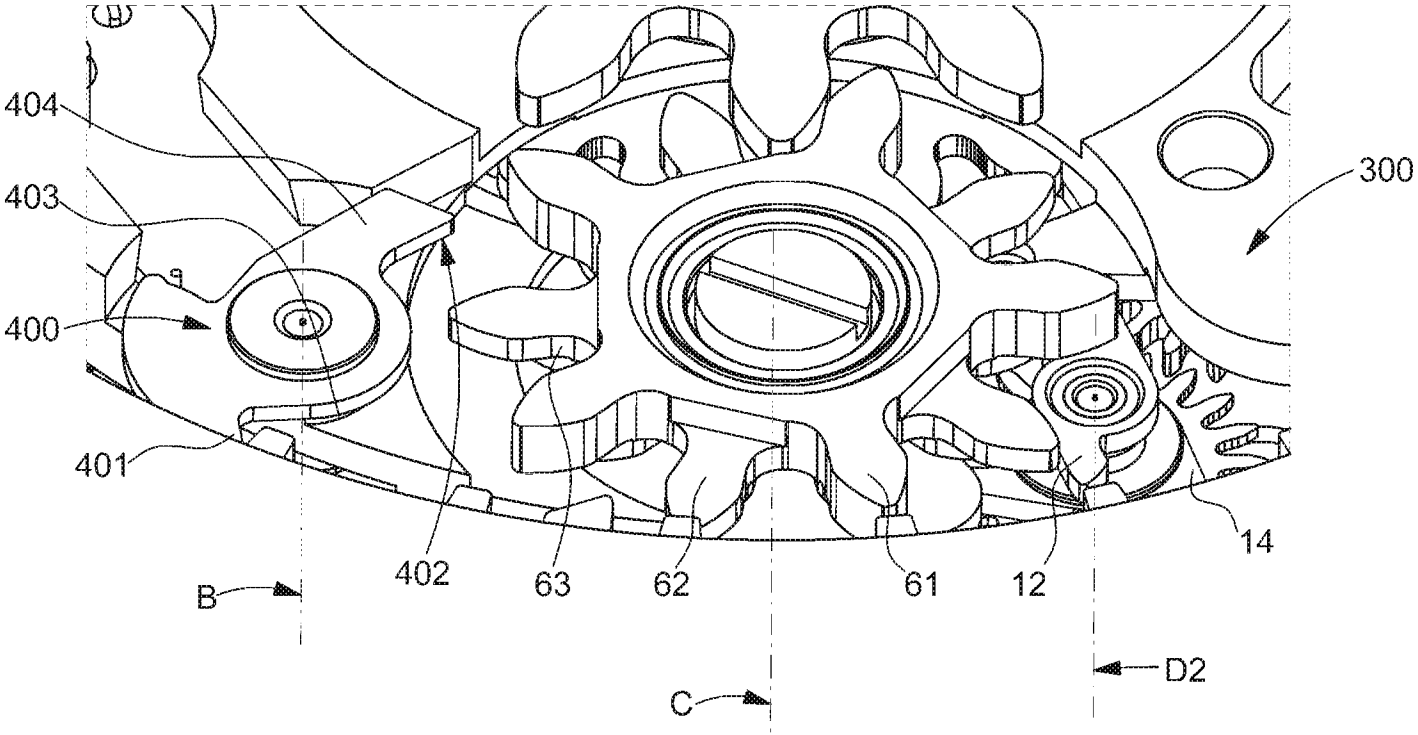
FIG. 5 shows a schematic perspective view of a detail similar to FIG. 1, in a position of cooperation between a safety lever specific to the invention and a date ring.
Figure 12:
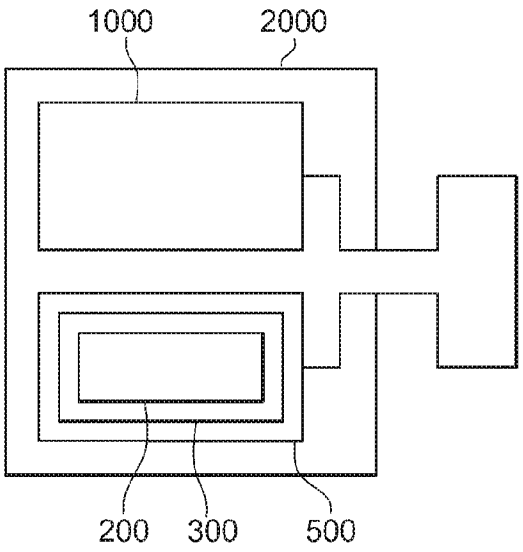
FIG. 12 is a block diagram representing a watch comprising a movement cooperating with a display mechanism according to the invention.
Figure 6:
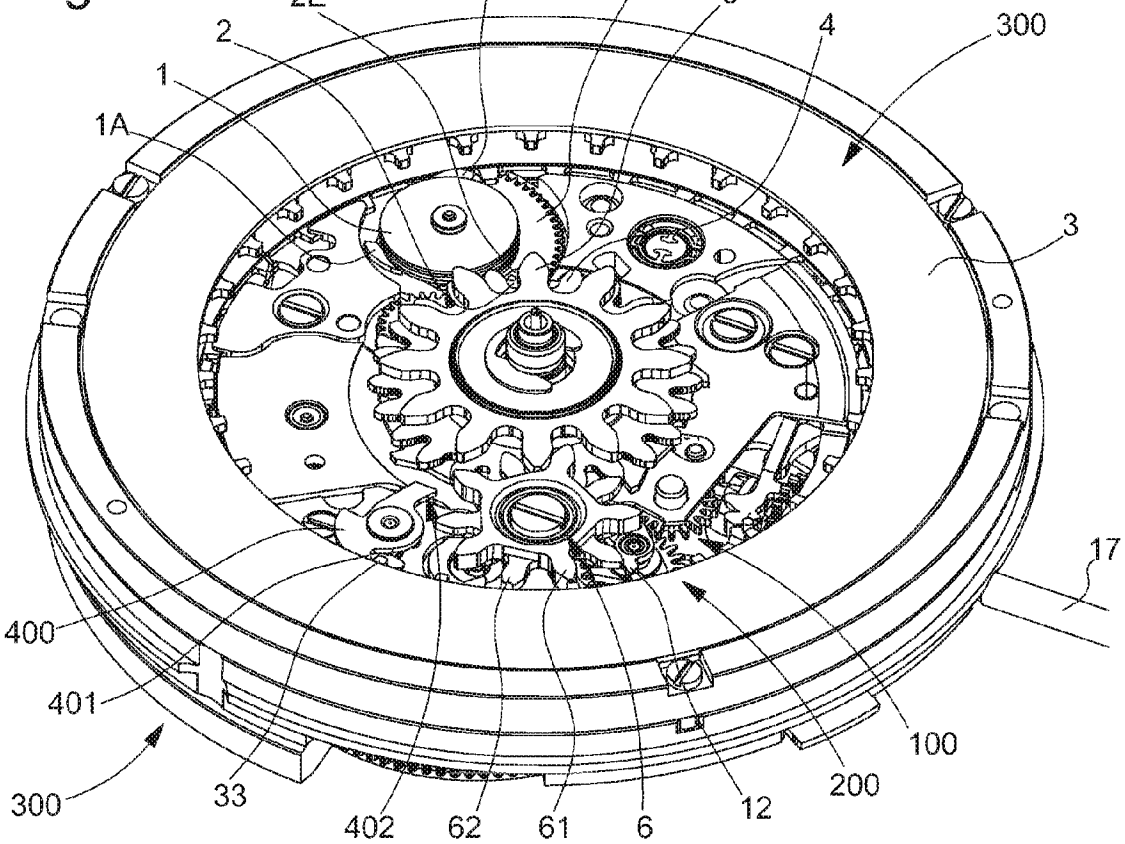
FIG. 6 shows a schematic perspective view, similar to FIG. 1, of the same mechanism in an ordinary date ring driving position.
Figure 9:
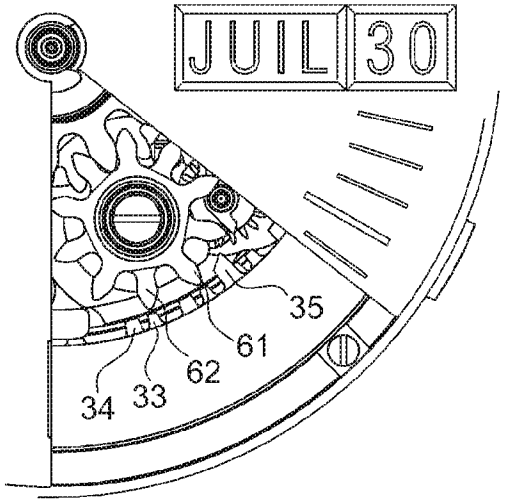
FIGS. 8 to 11 show partial plan schematic views of the annual calendar mechanism of the preceding Figures, equipped with a month disc carried by a month-star, and a date indicator ring carried by the date ring, in four successive positions changing to 29th July, to 30th July, to 31st July and to 1st August.
Figure 11:
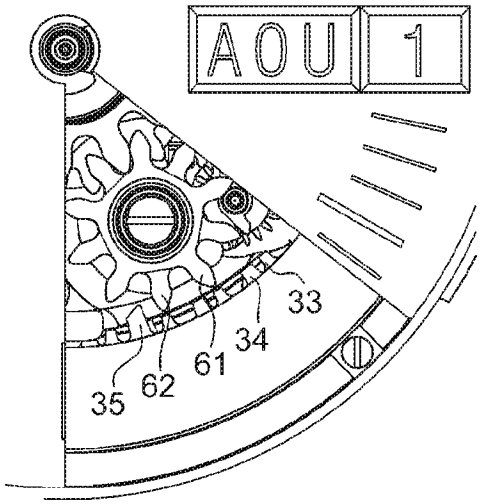
Figure 8:
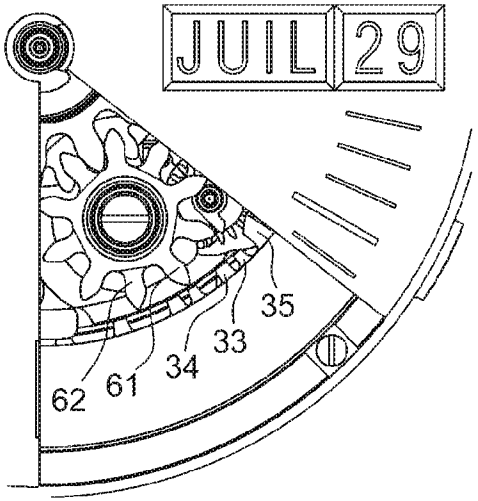
Figure 10:
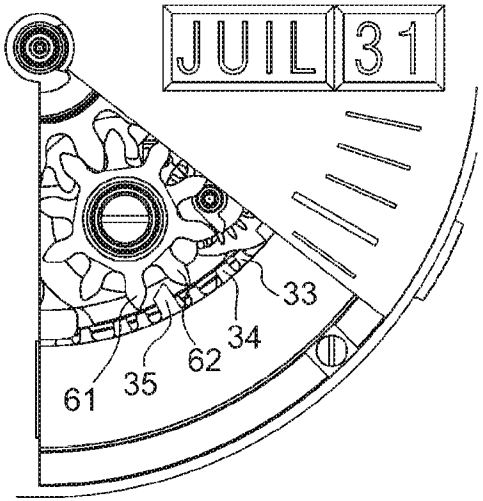

FIG. 7 illustrates a particular variant of date ring 3 which comprises three functional toothings 33, 34, 35, disposed on different superposed levels, here in three parallel planes. In this particular variant, fast correction mechanism 200 thus comprises one such intermediate wheel set 6 including the following, which are integral and arranged on parallel levels:

on a first upper level 30, a first intermediate wheel 61 arranged to cooperate, either with safety lever 400 which is also arranged to cooperate, on the same level, with fingerpieces 33 comprised in date ring 3, or with a month-star 5 mounted for free rotation on year wheel 4;

on a second intermediate level 31, a second intermediate wheel 62 arranged to cooperate, at the end of each month, with a lug 35 comprised in date ring 3;

on a third lower level 32, date ring 3 is arranged to be driven by date drive wheel set 1; a third intermediate wheel 63, integral and coaxial with the first intermediate wheel on first stage 61 and with the second intermediate wheel on second stage 62, is arranged to cooperate with year wheel 4, and an intermediate corrector wheel 12 comprised in fast date correction mechanism 200 is arranged to cooperate with the second intermediate wheel on second stage 62 for correction of the month.

More particularly, this calendar mechanism 300 further comprises, on a fourth level underneath third lower level 32, a corrector fingerpiece 14, comprised in fast date correction mechanism 200, and which is arranged to cooperate with teeth 34 located on lower level 32 of date ring 3, for correction of the date.

Date ring 3 may either be made in one-piece or with juxtaposed elements indexed with respect to each other.

A particular application of the invention concerns an annual calendar mechanism 300 as described in EP Patent No 1666991B by the same Applicant. Display wheel net 3 is described here, in a non-limiting manner, in the form of a date ring, arranged to carry at least one date indicator ring, not represented in the Figures This date ring may be, in a known manner, retained by a jumper spring in order to achieve a semi-instantaneous change.

This annual calendar mechanism 300, which may take the form of a module added to a mechanism of an existing movement, is arranged to be driven by a wheel 1C, for example an hour wheel, of a movement 1000, not represented in detail in the Figures, and which may equally well be a mechanical movement or an electronic movement.

This annual calendar mechanism 300 thus includes a date indicator drive wheel 1, which is equipped with two fingerpieces:

a first day fingerpiece 1A arranged to drive once per day, notably at midnight, a toothing comprising thirty-one inner teeth 34, on a lower level 32 of a date ring 3;

a second month fingerpiece 1B arranged to drive, at the end of months of less than thirty-one days, a cam 2 arranged coaxially to a year wheel 4.

This cam 2 comprises five radially protruding secondary lugs 2E which correspond to the months of less than thirty-one days: February, April, June, September, November, and which are angularly distributed as a function of the time interval between these respective months: 60°, 60°, 90°, 60°, 90°. Cam 2 is clear between these secondary lugs 2E, which means that the second month fingerpiece 12 only drives cam 2 on the last days of these particular months, the month of February requiring an additional manual correction, depending on the year.

Cam 2 is integral with a year wheel 4.

In the preferred embodiment illustrated by the Figures, this year wheel 4 comprises twenty-four teeth. It may be arranged to carry, in some variant embodiments, a month indicator disc or ring, not represented in the Figures.

In a particular variant, as seen in the Figures, year wheel 4 may carry a month-star 5, which rotates freely. Month-star 5 may be arranged to carry, in some variant embodiments, a month indicator ring or disc, not represented in the Figures.

At the end of each month, intermediate wheel set 6 is arranged to connect year wheel 4 to a main lug 35 located on a second intermediate level 31 of date ring 3.

Intermediate wheel set 6 comprises a second intermediate wheel 62. At the end of each month, regardless of the duration of the month, this second intermediate wheel 62 drives main lug 35.

Intermediate wheel set 6 cooperates, via a third intermediate toothed wheel 63 on a third lower level 32, with year wheel 4.

Intermediate wheel set 6 comprises, in the alignment of first upper level 30, a first intermediate wheel on first stage 61, integral with the second intermediate wheel of second stage 62. In the illustrated variant, the first intermediate wheel of first stage 61 cooperates with month-star 5 which is mounted for free rotation and held by friction.

In the illustrated variant, the first intermediate wheel of first stage 61 and third toothed wheel 63 each comprise ten equidistant teeth.

At the end of the months of less than thirty-one days, the second month fingerpiece 1B of date indicator drive wheel 1 drives cam 2, and year wheel 4 consequently drives, on the one hand, drive wheel set 6 and data ring 1 by means of its lug 35, and on the other hand, month-star 5.

At the end of the months of thirty-one days, the change from the thirty-first to the first occurs naturally, as does the change of month.

Date ring 3 comprises a particular arrangement, since it includes twenty-nine fingerpieces 33, located on an upper level 30 parallel to lower-level 32 where the thirty-one teeth 34 are arranged. These fingerpieces 33 are arranged to cooperate with an external beak 401 of safety lever 400, opposite to bearing face 402 comprised in safety lever 400, to push the toothing of first intermediate wheel 61 in the event of desynchronization.

The single main lug 35 of date ring 3 extends at least over the top of the second intermediate wheel of second stage 62. Consequently, on the thirtieth and thirty-first of the month, the system cannot lose synchronization, since main lug 35 is still meshed with intermediate wheel set 6.

At the end of the other days of the month, when date ring 3 effects its movement, one of the twenty-nine fingerpieces 33 drives safety lever 400, to ensure, if necessary, synchronization of the system, as explained above.

FIG. 7 shows the relative arrangement of the date ring levels. The toothing of twenty-nine fingerpieces 33, on upper level 30, is a toothing of thirty-one equidistant teeth from which two consecutive teeth have been removed. On second intermediate level 31, main lug 35 is positioned here between the second and third fingerpieces 33 which follow the tooth-free space located on upper level 30.

The toothing located on first upper level 30 is thus used only to enable synchronisation; its teeth are active and drive lever 400. Whereas the ordinary driving of date ring 30 is accomplished by toothing 4 comprising teeth 3, on third lower level 32.

Preferably, calendar mechanism 300 comprises at least one fast correction mechanism 200, which includes one or more corrector fingerpieces 12 or 14, arranged to change the angular position of an intermediate wheel set 6, and/or to act directly on the position of a display member, such as a disc or a ring, carrying a date, month, day, year, leap year or other ring. In the particular example illustrated by the Figures, fast correction mechanism 200 comprises a lever 100, pivoting about a first fixed axis D1, and which carries on a second axis D2, which is parallel to first axis D1, an output wheel set which comprises at least two stages and carries, on two different planes, at least a corrector fingerpiece 14 and a corrector intermediate wheel 12, which are arranged to change the position of a date wheel set or of a date correction wheel set, and of a month display member or of a month display correction wheel set. More specifically, corrector fingerpiece 14 cooperates with date ring 3 for correction of the date, and intermediate corrector wheel 12 cooperates with the second intermediate wheel of second stage 62 for correction of the month.

The invention also concerns a timepiece movement 1000 including an hour wheel driving at least one such calendar mechanism 300.

The invention also concerns a timepiece 2000, in particular a watch, including at least one such movement 1000 and/or at least one such display mechanism and/or one such calendar mechanism 300.

The invention provides novel security in the employment of a display mechanism with a fast correction function. Indeed, the user has no means of checking whether or not the system is synchronized. The invention enables the display mechanism, notably the calendar mechanism, to self-synchronize.

Naturally, the example of an annual calendar set out above is non-limiting, and those skilled in the art will know how to transpose it to other similar applications.

The invention claimed is:

1. A display mechanism for a timepiece, comprising:

a mechanism for fast correction of a position of a display wheel set, wherein the display mechanism comprises at least one intermediate wheel set configured to be cinematically bound with automatic drive means, and, inserted between the intermediate wheel set and the display wheel set, a safety lever configured to be driven by the display wheel set during periodic driving of the display wheel set, in a trajectory that interferes with a spatial volume of the intermediate wheel set, such that:

when the intermediate wheel set is correctly synchronized with the automatic drive means, the trajectory of the lever does not interfere with the intermediate wheel set;

when the intermediate wheel set is not correctly synchronized with the automatic drive means, in a fast correction, the trajectory thereof interferes with the intermediate wheel set, which the safety lever then drives in an opposite direction to a single direction of normal operation, to resynchronize the intermediate wheel set.

2. The display mechanism according to claim 1, configured to be driven by an automatic drive mechanism controlled by a timepiece movement, a kinematic chain of the display mechanism being configured to ensure periodic driving of at least a first display wheel set, the display mechanism comprising a fast correction mechanism including means to uncouple the automatic drive mechanism, and to replace at least one wheel set of the kinematic chain of the automatic drive mechanism with at least one other wheel set configured to drive, directly or indirectly, at least one display wheel set, and to effect a change of the position of the first display wheel set, wherein said fast correction mechanism comprises at least one intermediate wheel set configured to ensure, on a first stage, synchronization with the automatic drive means of the display mechanism, and wherein the display mechanism comprises, inserted between the intermediate wheel set and the display wheel set, a safety lever configured to be driven by the display wheel set during the periodic driving of the display wheel set, in a determined trajectory and in a travel that interferes with the spatial volume of the intermediate wheel set, relative arrangement of the safety lever and the intermediate wheel set, which are mounted to pivot about distinct parallel axes, such that:

when the intermediate wheel set is correctly synchronized, the trajectory of the safety lever does not interfere with the first stage of the intermediate wheel set and the safety lever is configured to pass at a distance from any other surface of the intermediate wheel set, without interfering with the intermediate wheel set;

when the intermediate wheel set is not correctly synchronized, the trajectory of the safety lever interferes with the first stage of the intermediate wheel set, and the safety lever is configured to drive the intermediate wheel set in the opposite direction to the single direction of normal operation, to resynchronize the intermediate wheel set.

3. The display mechanism according to claim 2, wherein the intermediate wheel set is configured to ensure the synchronization on the first stage, and, on a second stage, direct or indirect driving of the display wheel set other than the first display wheel set, and further wherein relative arrangement of the safety lever and of the intermediate wheel set is such that:

when the intermediate wheel set is correctly synchronized, the trajectory of the safety lever does not interfere with the first stage of the intermediate wheel set and the safety lever is configured to pass above and at a distance from the second stage of the intermediate wheel set, without interfering therewith;

when the intermediate wheel set is not correctly synchronized, the trajectory of the safety lever interferes with the first stage of the intermediate wheel set, and the safety lever is configured to drive the intermediate wheel set in the opposite direction to the single direction of normal operation, to resynchronize the intermediate wheel set.

4. The display mechanism according to claim 2, wherein the safety lever comprises elastic return means, which tends to permanently return the safety lever to a rest position, which is a start of a cooperation position, in a next period, with the display wheel set.

5. The display mechanism according to claim 2, wherein the display mechanism is a calendar mechanism, comprising a date drive wheel set configured to be controlled by a wheel of a timepiece movement and configured to control a year wheel, wherein at least one of the display wheel set is a date ring, and wherein the calendar mechanism comprises control means configured to drive, directly or indirectly, the at least one date ring, and the calendar mechanism further comprising a fast date correction mechanism configured to control, directly or indirectly, pivoting of the date ring, wherein the fast correction mechanism comprises the intermediate wheel set comprising the following, which are integral and arranged on parallel levels:

on a first upper level, a first intermediate wheel on the first stage configured to cooperate, either with the safety lever, which is also configured to cooperate, on a same level, with fingerpieces comprised in the date ring, or with a month-star mounted for free rotation on the year wheel;

on a second intermediate level, a second intermediate wheel on the second stage configured to cooperate, at an end of each month, with a lug comprised in the date ring which is configured to be driven, on a lower level, by the date drive wheel set;

on the third lower level, a third intermediate wheel, integral and coaxial with the first intermediate wheel of the first stage and with the second intermediate wheel of the second stage, is configured to cooperate with the year wheel, and on the third lower lever, an intermediate corrector wheel comprised in the fast date correction mechanism is configured to cooperate with the second intermediate wheel of the second stage for correction of the month.

6. The display mechanism according to claim 5, wherein the calendar mechanism further comprises, on a fourth level underneath the third lower level, a corrector fingerpiece, comprised in the fast date correction mechanism, and configured to cooperate with teeth comprised in the lower level of the date ring, for correction of the date.

7. The display mechanism according to claim 5, wherein the date ring comprises, on the upper level, a toothing of twenty-nine fingerpieces for driving the lever, parallel to a toothing of thirty-one teeth on the lower level for the driving and updating of the date ring by a movement or by a user, and, between the upper level and the lower level, on the second intermediate level, a single main lug for controlling the change of the month display.

8. A timepiece movement comprising an hour wheel driving at least one calendar mechanism according to claim 5.

9. A timepiece or watch including at least one timepiece movement according to claim 8.

* * * * *